US005394819A

United States Patent [19]

Aarnio

[11] Patent Number: 5,394,819

[45] Date of Patent: Mar. 7, 1995

[54] VEE BOTTOM STRUCTURE FOR BOAT

[75] Inventor: Pekka Aarnio, Helsinki, Finland

[73] Assignee: Palkkiyhtyma Oy, Helsinki, Finland

[21] Appl. No.: 74,838

[22] PCT Filed: Dec. 12, 1991

[86] PCT No.: PCT/FI91/00381

§ 371 Date: Jun. 9, 1993

§ 102(e) Date: Jun. 9, 1993

[87] PCT Pub. No.: WO92/11177

PCT Pub. Date: Jul. 6, 1992

[30] Foreign Application Priority Data

Dec. 18, 1990 [FI] Finland ..... 906253

[51] Int. Cl.[6] ..... B63B 1/00

[52] U.S. Cl. ..... 114/271; 114/56

[58] Field of Search ..... 114/56, 57, 271, 274

[56] References Cited

U.S. PATENT DOCUMENTS

| | | | |
|---|---|---|---|
| 2,353,020 | 7/1944 | Dyer | 114/56 |
| 3,195,496 | 7/1965 | Skuce, II | 114/271 |
| 3,369,512 | 2/1968 | Music . | |
| 3,661,109 | 5/1972 | Weiland . | |
| 3,862,612 | 1/1975 | Artemis . | |
| 4,083,320 | 4/1978 | Yost . | |
| 4,128,072 | 12/1978 | Wood, Jr. | 114/56 |
| 4,193,370 | 3/1980 | Schoell | 114/56 |
| 4,233,920 | 2/1980 | Wood et al. . | |
| 5,046,439 | 9/1991 | Goodson et al. | 114/56 |

FOREIGN PATENT DOCUMENTS 319982 10/1929 United Kingdom .

*Primary Examiner*—Stephen P. Avila

*Attorney, Agent, or Firm*—Merchant & Gould, Smith, Edell, Welter & Schmidt

[57] ABSTRACT

A Vee bottom structure for a boat includes a stern, a bow and sides which are symmetrical relative to a keel line. The bottom structure comprises a part extending from the stern towards the bow. This part includes central bottoms which are positioned at an angle to each other beside the keel line on either side thereof, and of side bottoms extending outward from outer margins of the central bottoms and positioned at an angle against the central bottom on the respective side.

11 Claims, 3 Drawing Sheets

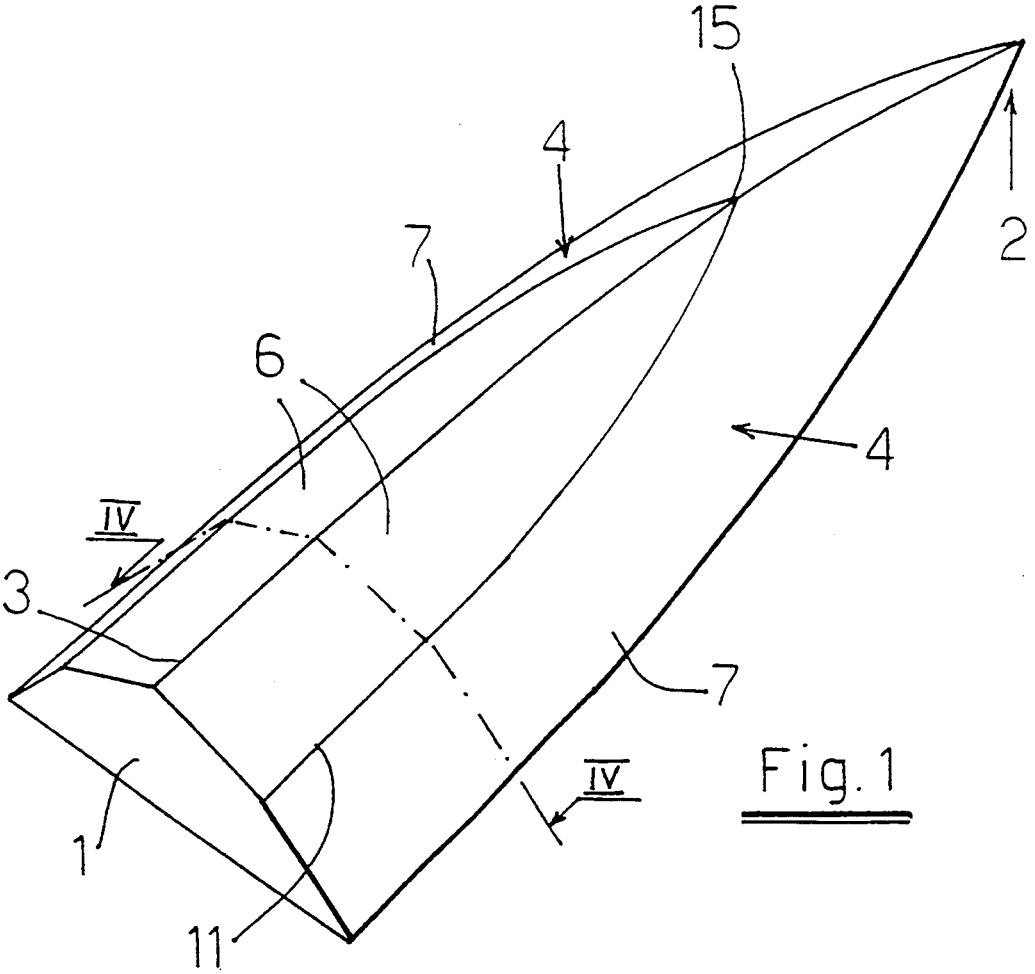
Fig. 1
Fig. 2
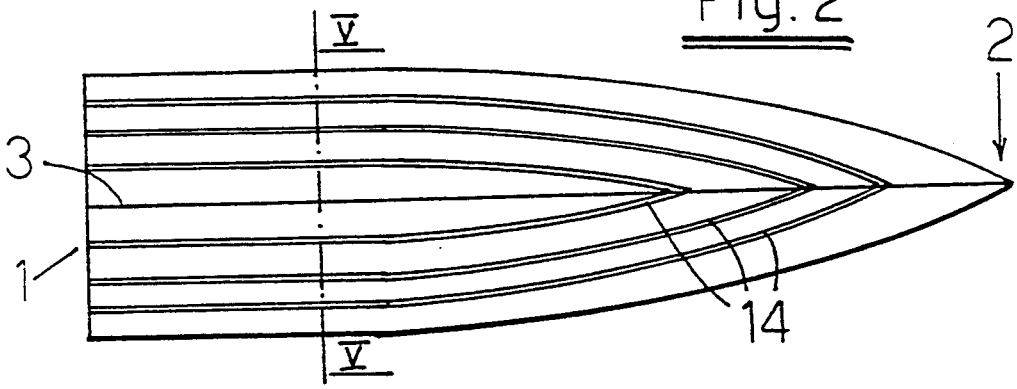
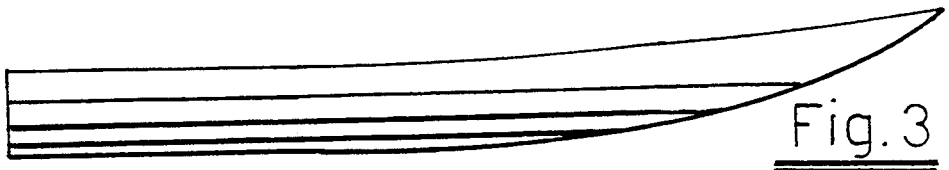
Fig. 3

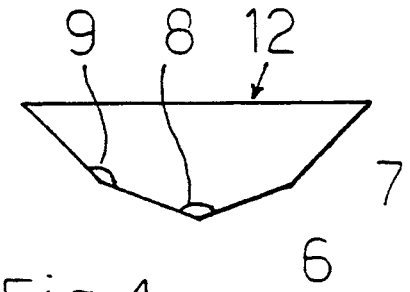
Fig. 4
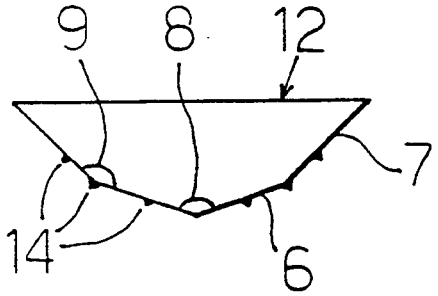
Fig. 5
Fig. 6
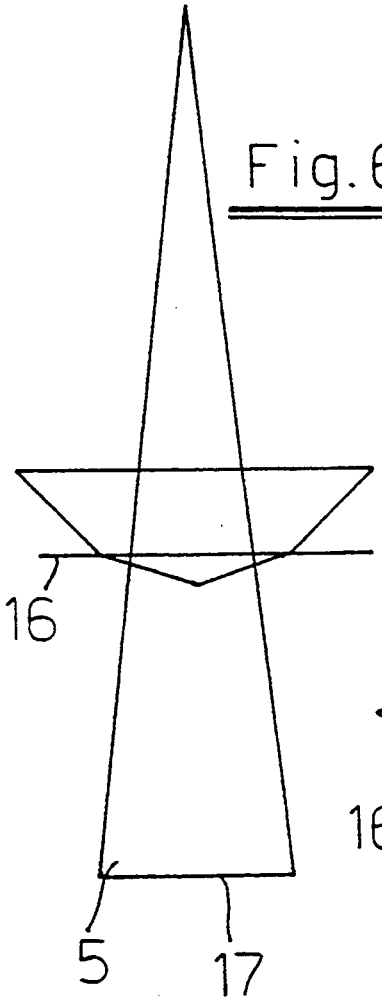
Fig. 7
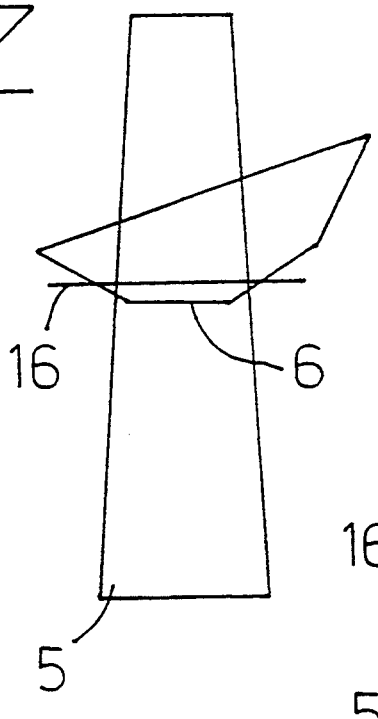
Fig. 8
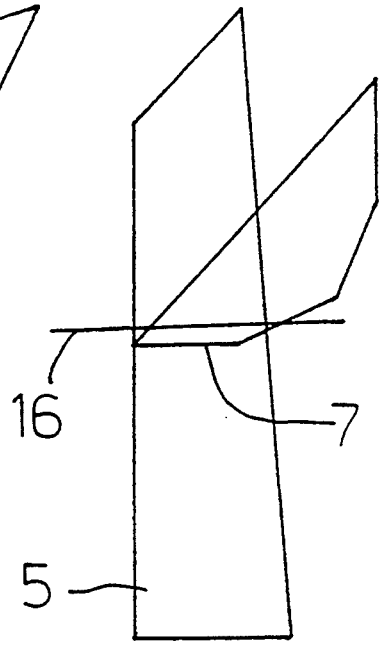

VEE BOTTOM STRUCTURE FOR BOAT

BACKGROUND OF THE INVENTION

The present invention concerns a bottom construction for a boat, as specified in the preamble to claim 1.

In designing the bottom structure of fast, planing boats endeavours are to minimize the water resistance, or the wet surface area of the boat, at the same time maintaining good running characteristics, directional stability and steerability of the boat.

One has in prior art attempted to improve the running characteristics of a boat by means of various transversal step designs with which the water flows are guided in desired manner underneath the bottom, and by which the boat is made to rise higher, thereby reducing the wet surface. Likewise known in bottom designs of prior art are various grooves, channels and other guides longitudinal to the boat, by which one attempts to maximize the favourable action of water flows under the bottom.

The problem associated with most bottom designs of prior art is, however, their high planing ascent threshold, that is, when the speed is accelerated the bow of the boat rises up steeply, and only after having gained a certain speed the bow sinks down and the boat rises and begins to plane. However, the boat keeps planing even at considerably lower speed.

The second problem with boats of prior art consists of its planing properties in sharp curves. If the hull shape in boats of prior art at all enables sharp turns at high speed, the hull sinks to rather great depth in the water, as a consequence of which the speed of the boat drops strongly, whereafter the planing ascent threshold has to be exceeded once more, in order to regain the original speed.

The third problem in fast boats of prior art consists of the powerful centrifugal forces in curves, a circumstance which significantly impedes any work done in a fast-moving boat. It also causes operating trouble in the case of various pieces of technical equipment, e.g. the armament which naval forces use in fast boats.

SUMMARY OF THE INVENTION

The object of the invention is to eliminate the drawbacks mentioned. In particular, the object of the invention is to provide a novel boat bottom construction which has no planing ascent threshold, which is nearly insensitive to various loads, which presents good steerability within the whole speed range of the boat, by which the detrimental effects of the centrifugal forces acting in curves can be eliminated, and by which the speed of the boat can be significantly increased without increasing the engine power.

Regarding the features which are characteristic of the invention, reference is made to the claims section.

The boat bottom structure of the invention comprises a transverse and substantially planar stern, a bow with comparatively pointed and tapering shape, and sides symmetrical with reference to the keel line, which form an outwardly substantially convex shell over the frame structure. As taught by the invention, the bottom structure comprises a bottom portion extending from the stern towards the bow up to a certain distance, this part of the bottom being constituted by central bottoms located on either side of the keel line and subtending with each other a keel angle and of outside bottoms extending outward from the outer margins, parallelling the keel line, of the central bottoms and subtending a bottom angle with the central bottom on the respective side. Furthermore, the widths of the side bottoms are at least equal to those of the central bottoms and, moreover, the bottom angles are at least equal to the keel angle. Moreover, in the bottom structure of the invention the bottom line, between a central bottom and the outside bottom, runs parallel with the keel line up to a certain distance from the stern of the boat towards its bow. Hereby, in the bottom structure of the invention there are three lines extending from the stern towards the bow and forming an angle on the bottom: the keel line in the centre of the bottom, and on both sides thereof, bottom lines which are parallel with the keel line.

Thus, in practice, the boat bottom of the invention comprises three side-by-side bottoms having mutually parallel keel lines. When travelling with such a boat straight forward or through a gentle curve, the boat runs on the central bottom, while sharper curves are negotiated running on one or the other side bottom, which operates with equal smoothness and stability in curves as the central bottom in straight runs.

Moreover, for instance when running obliquely into head waves the boat runs on two bottoms. In that case the central bottom rides upon the underlying water, and the side bottom takes on the waves coming from the beam, distributing them on either side of its own keel line. Hereby no waves coming from any direction whatsoever can hit at right angles against the sides of the boat; the different bottoms will at any time meet the water smoothly and with flexible guiding effect, whereby the pressures exerted by the water are uniformly distributed among the different bottoms and the boat runs in a stable and smooth manner in any and all circumstances, both on straight runs and in curves.

The side bottom may be wider than the central bottom by 0 to 20%, advantageously 0 to 10%, e.g. about 0 to 5%. The somewhat greater width of the side bottom, compared with that of the central bottom, ensures that the boat will present firm and safe tilting characteristics in curves, since a wider side bottom has a higher buoyancy effect than the narrower central bottom when the boat is in a tilted attitude, so that the boat tends to right itself to vertical position and capsizing is nearly impossible.

The keel angle may be 120° to 170° advantageously 130° to 160°, e.g. about 140° to 150°. The bottom angle may be 130° to 170° advantageously 140° to 160°, e.g. about 150° to 160°.

When, as taught by the invention, both bottom angles are greater than the keel angle between them, exceedingly stable running of the boat is thereby ensured because when the boat is running so that the keel line as well as one bottom line are submerged, the side bottom extending outward from the bottom angle is positioned at a gentler slope against the water surface than the central bottom extending outward from the keel line on the opposite side of the wet surface. Thereby the side bottom produces a higher buoyant force, righting the boat.

Advantageously, in the bottom construction of the invention the central bottoms and side bottoms in aggregate constitute the whole bottom structure of the boat, up to its deck level. It is thus understood that the hull of the boat comprises no substantially vertical sides longitudinal to it: the vertical structural components of the boat, if any, are only erected above deck level. Hereby, in the bottom structure of the invention the whole outside surface of the hull, up to deck level, constitutes a shell which forms the wet surface that is used in each instance, depending on the boat's attitude. The deck structures provided on the boat can vary freely, depending on the particular application. The structure may be completely open or partly open, or substantially fully closed. The deck superstructure may consist of various cockpit spaces and cabins, and of various armament arrangements including ancillary accessories.

Advantageously, the bottom lines between the central bottoms and the side bottoms run in one horizontal plane from the stern of the hull towards the bow, and they come together as the keel line, curving upward between them, intersects said plane.

Advantageously, in the bottom structure of the invention the central bottoms as well as the side bottoms are substantially straight planes in the longitudinal as well as lateral direction, up to a given distance bowwards from the stern of the boat, whereafter they curve uniformly, and taper, to form the pointed bow structure of the boat in such manner that only the side bottoms extend all the way to the point of the bows, while the central bottoms taper down around the keel line and terminate at a distance from the point of the bows towards the stern.

Advantageously, in the bottom structure of the invention the central bottoms as well as the side bottoms are substantially straight in the direction longitudinal to the boat, whereas in the direction across the boat they represent an outwardly convex, arcuate structure, up to a given distance from the bows towards the stern, whereafter they curve uniformly and taper down to form the pointed bow structure of the boat. It is equally conceivable that the side bottoms alone, or the central bottoms alone, are outwardly convex in the longitudinal direction while the other bottoms are straight planes both longitudinally and laterally.

Advantageously, the substantially uniform and unchanged hull cross section extending from the stern of the boat towards the bows extends over 15 to 60%, possibly 20 to 50%, e.g. about 30 to 40%, of the boat's total length.

In an embodiment of the invention, the central bottoms abut on each other on the keel line so that they form together a comparatively sharp-edged keel angle. It is however equally conceivable that in the keel region is provided a comparatively narrow, even keel plane on the margins of which the central bottoms abut.

It is also possible in the bottom structure of the invention to use various kinds of transversal stepped structures such as are employed in various connections: one or several steps at the very stern of the boat or at a certain distance from the stern. They do not change the inventive bottom design of the boat nor its function in curve conditions and in heavy sea, but they may afford good additional features in the boat's behaviour, depending on its size and on the conditions in which it is used.

In the hull design of the invention, advantageously, following after the substantially constant cross section of the hull the keel line curves substantially uniformly upward, the bottom lines formed by the bottom angles curve substantially uniformly upward and towards each other, and the side lines of the side bottoms on deck level curve substantially uniformly in horizontal direction towards each other, so that these lines confine and form the tapering bow part of the boat's hull. The curvature to which reference has been made in the foregoing extends, advantageously, over about half the length of the boat, whereby for instance the radius of curvature of the keel line will be on the order of the boat's length or larger.

Advantageously, the bottom structure of the invention comprises ascent mouldings running in parallel with the keel line and provided symmetrically on either side thereof, which may be attached either to the central bottom or to the side bottoms, or to both, and/or to their boundary surfaces.

The bottom structure of the invention can be used on boats of various types and sizes, and therefore its length may vary within 5 to 50 m, for instance. Since the hull structure of the invention is designed to be mainly used in heavy professional service of the naval forces and coast guard, furthermore possibly fitted with comparatively heavy armament and engine power, and which may get up to speeds between 50 and 100 knots, the hull length varies advantageously within 8 to 20 m in said applications. Therefore the weight of a boat according to the invention is advantageously over 1000 kg, e.g. on the order of 3000 to 5000 kg, while it may be rather much greater as well.

The engine power is in no way limited in a boat according to the invention: it may vary, depending on required top speeds and on boat size and weight, from a few hundred to several thousand hp, even up to several ten thousand hp. For engines, various types of inboard motor, inboard stern motor or outboard motor can be used, and the propeller may be totally immersed or disposed half above the water surface. It is equally possible to apply in the boat, various water jets and turbines, depending on particular application and desired performance characteristics.

The stern of the bottom structure of the invention may be vertical and even, but it may equally be upward or downward inclined. Likewise, inward pointing steps known in themselves in the art may be provided on the rear margin of the bottom, close to the stern.

The ratio of the boat's hull breadth and length is less than 0.35, advantageously 0.32 to 0.15, e.g. 0.30 to 0.20, whereby the hull is comparatively pointed and long relative to its breadth, compared with conventional fast boats used by the naval forces and the coast guard, for instance.

When the boat bottom structure of the invention is put through curves, the hull is arranged to tilt and curve in such a way that the resultant force of gravitation and of the centrifugal force acting on an object in the boat, caused by the curved travel, will virtually always act perpendicularly downward against the horizontal bottom plane of the boat. It is therefore an easy thing to stand upright in a boat according to the invention, even under high speed and in abrupt turns, because no objectionable lateral forces occur. This is of immense significance regarding operation of various armament systems, seeing that even in curves all the forces acting on the structures are directed downward in the case of various mechanical firearms as well as missiles; all these will therefore be constantly fully operable and fit to be used even when the boat is run at full speed through sharp curves.

The bottom structure of the invention affords the following advantages over the state of art:

the bottom structure has no planing ascent threshold—it rises to planing smoothly and without steps with increasing speed, without any upthrust of the bows;

thanks to the bottom structure no objectionable centrifugal forces occur in the boat;

the bottom structure is comparatively insensitive to weight changes, and it has good carrying capacity;

the bottom structure presents good steerability throughout the speed range;

in choppy water and in heavy seas the water-induced pressures are so distributed on the bottom that the boat of itself rights those movements which are due to wave action;

in spite of its light weight, the structure is strong, and favourable as regards building costs;

the hull is comparatively low-slung and therefore presents a minimal wind surface; and the structure has a small wet surface, which is conducive to high maximum speeds without detriment to directional stability.

BRIEF DESCRIPTION OF THE DRAWINGS

In the following the invention is described in detail with reference to the drawings hereto attached, wherein:

FIG. 1 presents a bottom structure according to the invention,

FIG. 2 presents another bottom structure according to the invention,

FIG. 3 shows the bottom structure of FIG. 2 in elevational view,

FIG. 4 presents a section of the bottom structure of FIG. 1,

FIG. 5 presents a section of the bottom structure of FIG. 2,

FIG. 6 presents a bottom structure according to the invention and its wet surface during a straight run, FIG. 7 presents a bottom structure according to the invention and the corresponding wet surface during a gentle turn, FIG. 8 presents a bottom structure according to the invention and the corresponding wet surface during a sharp turn, and FIG. 9 displays a diagram of the bottom structures presented in Table 1.

DETAILED DESCRIPTION OF THE PREFERRED EMBODIMENT

Figure 9:
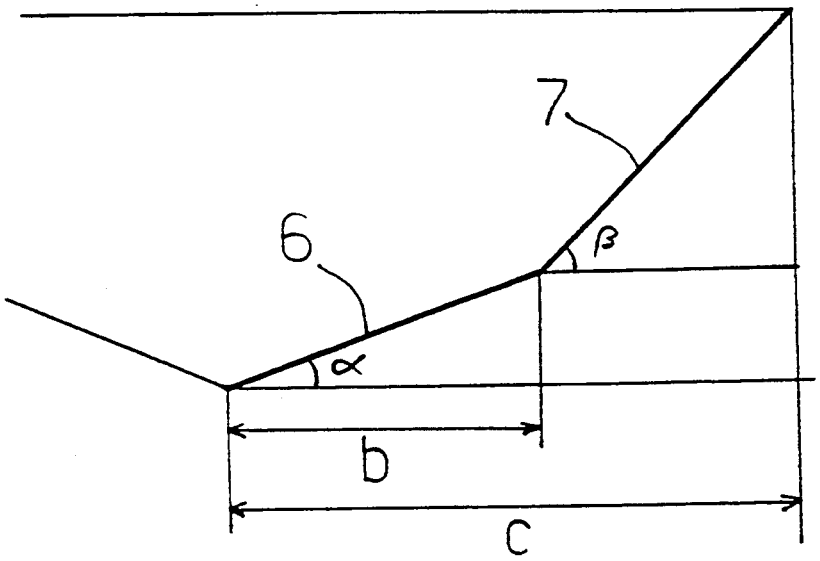

The Vee bottom structure of a fast-running boat according to the invention, depicted in FIG. 1, consists of sides 4 which are symmetric relative to the keel line 3 and join each other in the forward part of the boat to produce pointed bows 2, and of a plate-like stern 1 perpendicular against the keel line and substantially vertical. The sides 4 consist of central bottoms 6 abutting on the keel line and positioned at an angle to each other, and of side bottoms 7 which constitute the shell of the hull, from the outer margins of said central bottoms up to the deck plane 12 of the hull.

The central bottoms 6 consist of substantially smooth and straight plates extending from the stern 1 with uniform width up to a distance toward the bow 2, said distance being, in the present embodiment, about 30% of the boat's length. Thereafter the central bottoms taper down bowwards and join to form a sharp point 15 on the keel line 3, at a distance from the bow 2 towards the stern 1.

The central bottoms form on the keel line 3 a keel angle 8, this angle being for instance 144°, in a prototype corresponding to the figure that has been manufactured. However, the angle may vary in accordance with the boat's dimensions and with those properties which are desired. The prototype now in question has a length of about 10 m, and its breadth is about 3 m.

The side bottoms 7 constitute, likewise similarly as the central bottoms 6, on a stretch of about 30% from the stern, a straight and smooth part of the shell of the boat's hull, this shell part being positioned at an angle to the central bottom on the respective side. Hereby a bottom angle 9 is formed between the central bottom and the side bottom, the bottom line 11 defined by this angle on the bottom of the boat being substantially parallel to the boat's keel line over the said 30% of the boat's total length from the stern towards the bows. Similarly, the upper margins of the side bottoms 7, i.e., their margins abutting on the deck level 12, parallel the bottom lines 11 and the keel line 3, so that the cross section configuration of the boat's hull is constant over said distance of about 30%.

The bottom angle 9 between the side bottoms 7 and the central bottoms 6 may be e.g. 153°, but its magnitude may likewise vary on different types of hull. The upper margin of the side bottom 7 in the deck plane 12, or the side line 13, curves after the straight portion fairly gently towards the bows 2 of the boat so that the side bottoms run together from the boat's sides and join in the bow region on the keel line 3, forward of the sharp point 15 formed by the central bottoms, to form a bow structure which is pointed and slightly upward curving from the stern deck plane.

The boat bottom structures depicted in FIGS. 2, 3 and 5 differ from those of FIGS. 1 and 4 only in that ascent mouldings 14 have been attached to them. In the embodiment here depicted there are three pairs of ascent mouldings, and they are attached to the bottom line 11 between the central bottoms 7 and the side bottoms 7, on the centre-line of the central bottoms substantially parallel with the bottom lines 11 and at a distance from the bottom lines, substantially parallelling the bottom lines 11. The ascent lines need not absolutely extend all the way up to the keel line 3 in the bows to meet each other, but it is essential that the ascent lines parallel the keel line 3 all through the constant cross section area of the hull structure's stern part.

In FIG. 6 is shown the cross section of a bottom structure according to the invention in its normal upright position upon the water surface 16. Then, if the boat is planing, the configuration of the wet surface is an isosceles triangle, its base 17 substantially constant but its height varying in accordance with the boat's speed.

As can be seen in FIG. 7, with the boat running through a gentle curve and when one of the central bottoms 6 is parallel with the water surface 16, the wet surface 5 assumes, as in FIG. 7, the configuration of an isosceles trapeze.

As shown in FIG. 8, when the boat is put through a sharp turn so that one side bottom 7 is parallel with the water surface, the wet surface 5 becomes a quadrangle as seen in FIG. 8.

The configuration of the wet surface varies in the way illustrated by FIGS. 6 to 8, depending on how steep a curve is being negotiated. However, the total area of the wet surface does not change substantially: it is roughly constant all the time. Hereby the resistance from the water is substantially constant, and the boat travels with comparatively uniform speed also in curves and sharp bends, and even in heavy sea.

TABLE 1

| | Stern | | | | Relative boat length | | | | | Bows | |
|---|---|---|---|---|---|---|---|---|---|---|---|
| | 0 | 0.1 | 0.2 | 0.3 | 0.4 | 0.5 | 0.6 | 0.7 | 0.8 | 0.9 | 1 |
| Boat I | | | | | | | | | | | |
| b | 0.28 | 0.28 | 0.28 | 0.28 | 0.28 | 0.26 | 0.21 | 0.14 | 0.02 | 0 | 0 |
| c | 0.5 | 0.5 | 0.5 | 0.5 | 0.5 | 0.49 | 0.44 | 0.38 | 0.29 | 0.16 | 0 |
| $\alpha$ | 18° | 18° | 18° | 18° | 18° | 19° | 22° | 27° | 33° | — | — |
| $\beta$ | 45° | | | | | | | | | | |
| Boat II | | | | | | | | | | | |
| b | 0.29 | 0.29 | 0.29 | 0.29 | 0.28 | 0.24 | 0.19 | 0.11 | 0 | 0 | 0 |
| c | 0.5 | 0.5 | 0.5 | 0.5 | 0.49 | 0.47 | 0.43 | 0.36 | 0.26 | 0.14 | 0 |
| $\alpha$ | 17° | | | | | | | | | | |
| $\beta$ | 45° | | | | | | | | | | |

Referring to FIG. 9, in Table 1 are presented the longitudinal profiles of the bottom structures of two prototypes that have been built. The lengths of these two prototypes were on the order of 8 to 10 m. The angle $\alpha$ is the acute angle between the horizontal plane and the central bottom 6, and the angle $\beta$ is the acute angle between the horizontal plane and the side bottom 7. The symbol c stands for one half of the total breadth of the boat's bottom structure, compared with the boat's breadth at the stern, and b stands for the relative breadth of the central bottom 6, i.e., the length of its horizontal projection related to the boat's breadth at the stern.

As can be seen in Table 1, the hull structure of boat I is uniform in thickness from the stern towards the bow up to a given distance, which is in the range of 0.4 to 0.5 of the boat's length, the breadth of this uniformly thick portion of the boat also being the maximum breadth of the boat. The value of b may advantageously vary in the range from 0.24 to 0.32 on the uniformly thick part of the hull, and c is in the range from 0.46 to 0.54.

The angle $\alpha$, which is 18° on the uniform part of the hull structure, may in different embodiments vary in the range of 9° to 22°. These values correspond to keel angle 144°, respectively to the range of 136° to 162°. Likewise, the angle $\beta$, which is 45° on the uniform portion of the hull structure, may in different embodiments vary, on the uniform portion, in the range of 35° to 50°, which corresponds, also depending on the angle $\alpha$, to values of the bottom angle in the range of 139° to 167°.

Boat II is otherwise substantially similar to Boat I as to its hull structure, except that the angle $\alpha$ is slightly smaller and the hull is uniform in thickness, from the stern toward the bows, only on the interval up to 0.3 to 0.4 of the boat's length, whereafter it tapers down comparatively uniformly. The relative length of the projection b is also somewhat greater, owing to reduction of the angle $\alpha$.

In the foregoing, the invention has been described by way of example with the aid of the enclosed drawings, while different embodiments of the invention are feasible within the scope of the inventive idea delimited by the claims.

I claim:

1. A Vee bottom structure for a boat, for use on fast, planing boats, comprising a stern, a bow, and sides which are symmetrical relative to a keel line and which constitute an outwardly substantially convex structure, characterized in that the bottom structure comprises a part extending from the stern towards the bow up to a certain distance, this part including central bottoms which are positioned at an angle to each other beside the keel line on either side thereof, and of side bottoms extending outward from outer margins of said central bottoms and positioned at an angle against the central bottom on the respective side;

each of a plurality of bottom lines between each of the central bottoms and each of the side bottoms is parallel with the keel line up to a certain distance from the stern towards the bow;

the breadth of the side bottom is at least equal to the breadth of the central bottom;

the bottom angle between the central bottom and the side bottom is greater than an keel angle between the central bottoms so that the boat is stable and not capsize;

wherein the bottom angles in the range of 130° to 170°, advantageously 140° to 160°, e.g. 150° to 160°;

wherein the central bottoms and the side bottoms in combination constitute a bottom structure of the boat up to the level of its deck plane;

wherein the bottom lines run in one plane, which includes a horizontal plane, from the stern of the hull, coming together with the upward curving keel line;

wherein the central bottom and the side bottom are substantially straight planes both in the longitudinal and lateral direction, up to a certain distance towards the bow from the stern of the boat; and wherein a substantially uniform and unchanged hull cross section extends from the stern of the boat 15 to 60% of the boat's length, advantageously 20 to 50%, e.g. about 30 to 40%.

2. Bottom structure according to claim 1, characterized in that the central bottoms abut on each other immediately on the keel line, forming a keel angle.

3. Bottom structure according to claim 1, characterized in that after the substantially unchanging cross section of the hull the keel line, the bottom lines formed by the bottom angles and the margin lines of the side bottoms on deck level curve substantially smoothly forward and upward towards each other, forming a pointed bow part of a boat's hull.

4. Bottom structure according to claim 3, characterized in that on the bottom, from the stern towards the bow and symmetrically with reference to the keel line, belong ascent mouldings attached to the central bottoms, to the side bottoms and to the bottom lines therebetween.

5. Bottom structure according to claim 4, characterized in that the ascent mouldings extend substantially over a whole length of the boat, curving in the bows into the vicinity of the keel line curving towards the deck plane of the hull.

6. Bottom structure according to claim 5, characterized in that the length of the boat's hull is in the range of 5 to 50 m, advantageously 8 to 20 m.

7. Bottom structure according to claim 6, characterized in that thr ratio of the boat's hull breadth to its length is less than 0.40, advantageously in the range of 0.32 to 0.10, e.g. 0.30 to 0.20.

8. Bottom structure according to claim 7, characterized in that when the boat is run through curves the hull tilts and curves in such manner that the resultant force acting on an object in the boat through the effect of gravity and of centrifugal force is substantially at all times perpendicular against the horizontal plane of the boat's bottom.

9. Bottom structure according to claim 7, characterized in that the part extending from the stern towards the bow up to a certain distance extends at least to a region of a wet surface which the boat uses when planing.

10. Bottom structure according to claim 9, characterized in that the wet surface of the bottom structure in planing changes configuration at different degrees of sharpness of the curves, yet its area is substantially constant at any given speed.

11. Bottom structure according to claim 10, characterized in that when the boat is driven the bottom structure comprises three side-by-side and substantially similar bottoms, the boat being driven straight forward on the centremost bottom and in sharp curves on the sidemost bottoms, while the latter also take up obliquely meeting waves in straight runs.

* * * * *